US011454935B2

(12) United States Patent
Tortora

(10) Patent No.: US 11,454,935 B2
(45) Date of Patent: Sep. 27, 2022

(54) MYSTERY-DRIVE MECHANICAL OR ELECTROMECHANICAL TIMEPIECE

(71) Applicant: The Swatch Group Research and Development Ltd, Marin (CH)

(72) Inventor: Pierpasquale Tortora, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 344 days.

(21) Appl. No.: 16/513,972

(22) Filed: Jul. 17, 2019

(65) Prior Publication Data

US 2020/0073330 A1 Mar. 5, 2020

(30) Foreign Application Priority Data

Sep. 5, 2018 (EP) ..... 18192682

(51) Int. Cl.
*G04B 45/04* (2006.01)
*G04B 37/11* (2006.01)
(Continued)

(52) U.S. Cl.
CPC ..... *G04B 45/04* (2013.01); *G04B 31/08* (2013.01); *G04B 37/11* (2013.01); *G04B 39/004* (2013.01); *G04B 45/046* (2013.01)

(58) Field of Classification Search
CPC ..... G04B 31/08; G04B 37/11; G04B 39/004; G04B 45/04–046
See application file for complete search history.

(56) References Cited

U.S. PATENT DOCUMENTS 2,466,312 A * 4/1949 Heintz ..... G04B 45/04 368/77
2,852,908 A * 9/1958 Stern ..... G04B 45/046 368/77
(Continued)

FOREIGN PATENT DOCUMENTS

CH 710 542 A1 6/2016
CN 2198622 Y 5/1995
(Continued)

OTHER PUBLICATIONS

Komata, Fujiro, English Translation of JP2009085758, originally published on Apr. 23, 2009, retrieved on Sep. 29, 2021, full document (Year: 2009).*
(Continued)

*Primary Examiner* — Daniel P Wicklund
(74) *Attorney, Agent, or Firm* — Oblon, McClelland, Maier & Neustadt, L.L.P.

(57) ABSTRACT

A mechanical or electromechanical timepiece including a watch case delimiting an internal volume, the watch case including a back delimiting the watch case at the bottom; a crystal closing the watch case at the top, the crystal defining a useful display aperture; a middle part connecting the back and the crystal to one another; a horological movement housed in the internal volume of the watch case; at least one hand for displaying information visible via a useful display aperture and rotated with respect to the watch case by the horological movement with at least one driving belt extending at least partially in the useful display aperture, the timepiece includes the internal volume of the watch case filled with a fluid wherein at least one driving belt is submerged, and wherein the driving belt is made of a material wherein the optical refractive index is equal or substantially equal to that of the fluid.

15 Claims, 3 Drawing Sheets

(51) Int. Cl.
*G04B 39/00* (2006.01)
*G04B 31/08* (2006.01)

(56) References Cited

U.S. PATENT DOCUMENTS

| | | | | |
|---|---|---|---|---|
| 5,199,006 | A | 3/1993 | Ferrara | |
| 5,878,003 | A * | 3/1999 | Gantet | G04B 45/04 368/76 |
| 10,976,707 | B2 * | 4/2021 | Husson | G04B 39/002 |
| 2005/0102869 | A1 | 5/2005 | French | |
| 2005/0122844 | A1 | 6/2005 | Ruchonnet | |
| 2008/0095968 | A1 * | 4/2008 | Semon | G04D 3/0069 428/66.1 |
| 2009/0185453 | A1 | 7/2009 | Wiederrecht et al. | |
| 2010/0195449 | A1 | 8/2010 | Ruchonnet | |
| 2013/0329534 | A1 * | 12/2013 | Ruchonnet | G04B 37/0058 368/220 |
| 2017/0248917 | A1 * | 8/2017 | Vouillamoz | G04B 1/265 |
| 2018/0095427 | A1 * | 4/2018 | Francois | G04B 39/02 |

FOREIGN PATENT DOCUMENTS

| | | | |
|---|---|---|---|
| CN | 2359718 | Y | 1/2000 |
| CN | 2686026 | Y | 3/2005 |
| CN | 1672102 | A | 9/2005 |
| CN | 1679069 | A | 10/2005 |
| CN | 101512446 | A | 8/2009 |
| CN | 104204967 | A | 12/2014 |
| EP | 0 509 965 | A1 | 10/1992 |
| EP | 1 884 841 | A1 | 2/2008 |
| GB | 2 235 793 | A | 3/1991 |
| JP | 2005-54822 | A | 3/2005 |
| JP | 2006-284256 | A | 10/2006 |
| JP | 2009-85758 | A | 4/2009 |
| JP | 2017-142190 | A | 8/2017 |
| WO | WO 2004/006026 | A2 | 1/2004 |
| WO | WO 2005/123324 | A1 | 12/2005 |

OTHER PUBLICATIONS

Combined Chinese Office Action and Search Report dated Nov. 10, 2020 in Chinese Patent Application No. 201910828087.4 (with English translation), 12 pages.

European Search Report dated Mar. 18, 2019 in European Application 18192682.5 filed Sep. 5, 2018 (with English Translation of Categories of Cited Documents).

* cited by examiner

MYSTERY-DRIVE MECHANICAL OR ELECTROMECHANICAL TIMEPIECE

CROSS-REFERENCE TO RELATED APPLICATION

This application claims priority to European Patent Application No. 18192682.5 filed on Sep. 5, 2018, the entire disclosure of which is hereby incorporated herein by reference.

FIELD OF THE INVENTION

The present invention relates to timepieces, and in particular timepieces suitable for itinerant use, such as wristwatches or pocket watches. More specifically, the invention relates to a mystery-drive mechanical or electromechanical timepiece.

TECHNOLOGICAL BACKGROUND OF THE INVENTION

The term mechanical or electromechanical timepiece denotes a timepiece, in particular a wristwatch, wherein the members for indicating time or other information such as a set of hour and minute hands are driven by a horological movement to which power is supplied either by a barrel spring (mechanical movement), or by an electrical power source (electromechanical movement).

Timepieces with mechanical or electromechanical movements are the subject of ongoing research, the designers thereof intensifying their originality and creativity. In particular, numerous developments relate to complications, to improvements of the mechanical movement of the timepieces, or to design innovations.

Document WO 2004/006026 describes a timepiece comprising a mechanical movement driving time display hands by means of driving belts. This time display hands pivot over a dial and are visible through the timepiece crystal. The dial is opaque and conceals the mechanical movement and the driving belts.

Some timepieces are devoid of a dial or have a transparent dial so as to give the user a view of the internal volume of the watch case present below the hands. If such an arrangement were adopted for the timepiece described above, the user would be able to view the hand driving belts.

The benefit of designing a timepiece devoid of a dial or of equipping such a timepiece with a transparent dial lies in that the owner can view in detail the various components making up the horological movement, the movement of some of these components being even perceptible. This renders such timepieces very attractive for the owners thereof who are capable of appreciating the great care taken in the execution of these horological movements.

An additional difficulty is overcome in the case of mystery-drive type timepieces. These so-called mystery timepieces fascinate and amaze the owners thereof, as they give the feeling that the hands thereof levitate in a vacuum. The owners thereof seek to find out by which invisible force the suspended hands move, or how they manage to escape the laws of universal gravity. Indeed, these mystery timepieces, wherein the dial is usually strictly transparent, do not show any component connected with the hands.

Therefore there is a need for a mystery-drive type mechanical or electromechanical timepiece wherein the owner can distinguish the internal volume of the watch case situated behind the hands, without however managing to identify the hand drive mechanism. There is also a need for a timepiece comprising a watch case with a transparent back so that the user can look through the timepiece from one end to the next to the watch back crystal. The mystery aspect of the drive mechanism is then increased further. There is also a commercial need for a mystery timepiece comprising a drive mechanism of a new type, that is simpler to implement and rendering the drive of the members displaying the time or another time-related quantity or not completely imperceptible.

The aim of the invention is that of providing a timepiece meeting one or more of these requirements.

SUMMARY OF THE INVENTION

The purpose of the present invention is that of providing a mechanical or electromechanical timepiece comprising a mystery-drive movement of at least one member for displaying a time-related or other quantity. In particular, the aim of the present invention is that of providing a mystery-drive mechanism which is completely imperceptible by the owner of the timepiece, for example a wristwatch, and which is also somewhat simpler to implement, so as to be able to offer a mystery timepiece at a contained price and therefore more readily accessible for buyers.

To this end, the present invention relates to a mechanical or electromechanical timepiece comprising a watch case delimiting an internal volume, this watch case including:

- a back delimiting the watch case at the bottom;
- a crystal closing the watch case at the top, this crystal defining a useful display aperture;
- a middle part connecting the back and the crystal to one another;
- a movement housed in the internal volume of the watch case;
- at least one hand for displaying information visible via the useful display aperture and rotated with respect to the watch case by the movement by means of at least one belt extending at least partially in the useful display aperture;
- the timepiece being characterised in that the internal volume of the watch case is filled with a fluid in which the at least one belt is submerged, and in that the belt is made of a material whose optical refractive index is equal or substantially equal to that of the fluid.

According to special embodiments of the invention:

- the fluid in which the at least one belt is submerged is transparent;
- the material used to produce the at least one driving belt is charged with a fluorescent or phosphorescent pigment;
- the material with which the at least one driving belt is made is charged with a percentage of fluorescent or phosphorescent pigment between 1% and 10%;
- the movement is arranged outside the useful display aperture;
- the back is formed by a transparent crystal;
- the fluid is a liquid or an oil bath;
- the ratio between the optical refractive index of the fluid and that of the material in which the belt is made is between 0.9 and 1.1;
- the belt is made of silicone;
- the at least one belt is notched and is engaged with a fluted pinion whereon the at least one hand is fixedly mounted;

the fluted pinion is transparent and has an optical refractive index substantially equal to that of the at least one notched belt;

a further hand is arranged in the useful display aperture and is rotated with respect to the watch case by the movement by means of a further belt extending at least partially in the useful display aperture, this further belt having the same or substantially the same optical refractive index as the fluid;

the internal volume of the watch case is devoid of gas pockets.

Owing to these features, the present invention provides a mechanical or electromechanical timepiece including a movement driving a hand by means of a belt. The belt is submerged in a preferentially transparent fluid confined in the internal volume of a watch case. The belt is also transparent and has an optical refractive index equal or very similar to that of the fluid. Thus, the user can see through the internal volume of the watch case due to the transparency of the fluid, but, due to the equality of the optical refractive indexes of the fluid and the material in which the belt is made, cannot make out the belt submerged in the fluid. Thus, a mystery drive effect is obtained for the timepiece, the belt not being perceptible by the user observing the internal volume of the watch case.

BRIEF DESCRIPTION OF THE FIGURES

Further features and advantages of the present invention will emerge more clearly from the following detailed description of an example, this example being given merely by way of illustration and not limitation merely with reference to the annexed drawings in which.

DETAILED DESCRIPTION OF AN EMBODIMENT OF THE INVENTION

The present invention proceeds from the general inventive concept which consists of rendering a driving belt imperceptible, this belt being present in an internal volume of a watch case and extending at least partially in the useful display aperture defined by the watch crystal. To achieve this result, the internal volume of the watch case is filled with a fluid in which is submerged a driving belt having a similar optical refractive index to that of the fluid.

Figure 1:
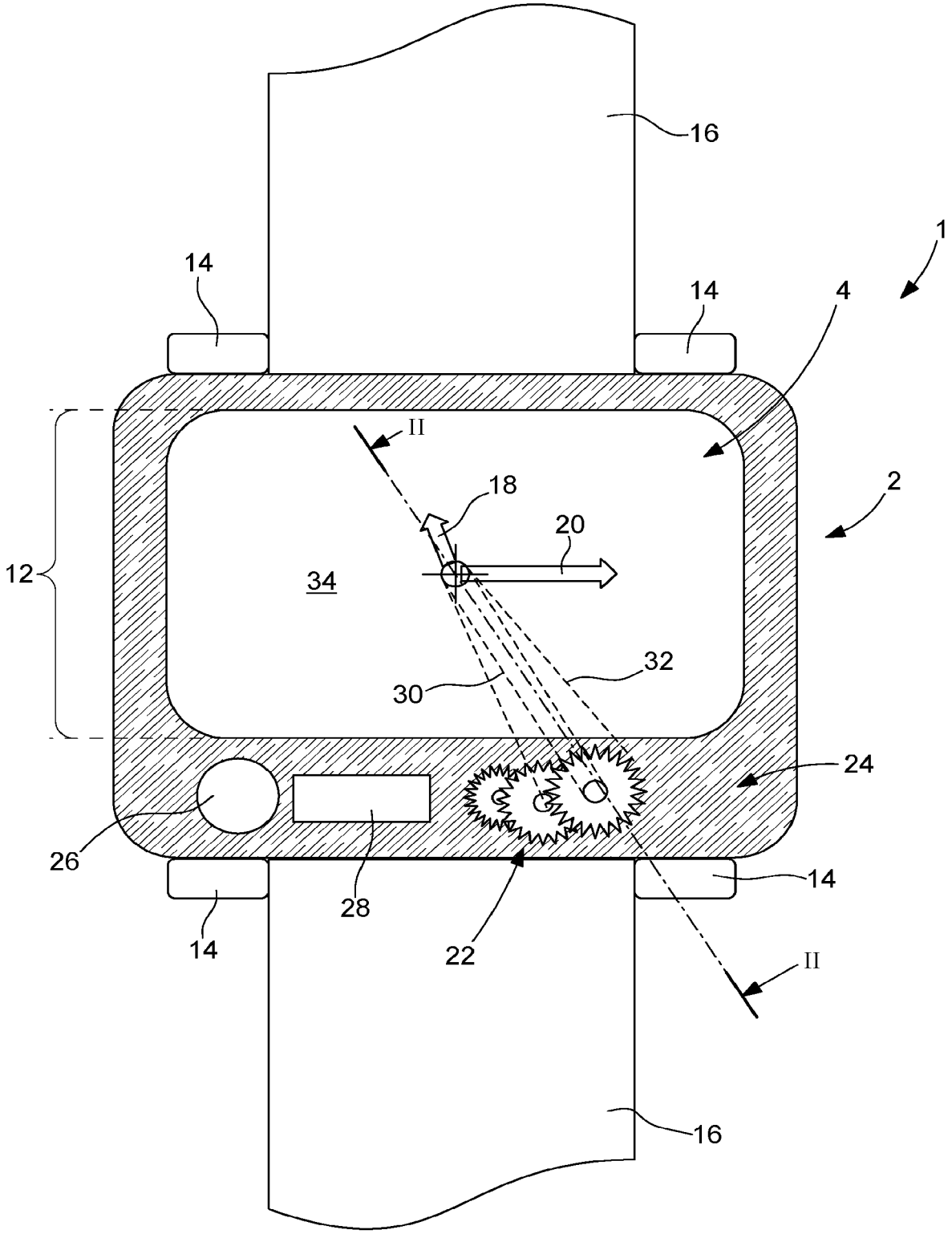
FIG. 1 is a front view of a wristwatch type timepiece according to the invention.
Figure 2:
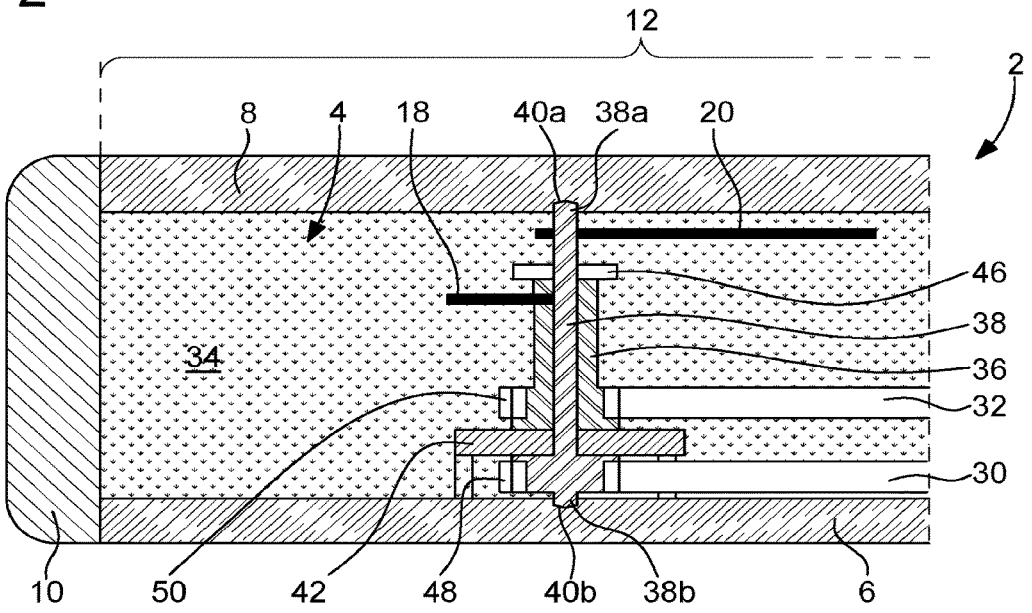
FIG. 2 is a partial sectional view of the wristwatch in FIG. 1.

FIG. 1 is a front view of an example of an embodiment of a wristwatch type timepiece 1 according to the invention. FIG. 2 is a partial sectional view of the wristwatch along line II-II of FIG. 1.

The timepiece 1 comprises a watch case 2 which delimits an internal volume 4. The watch case 2 comprises in a manner known per se a back 6, a crystal 8 and a middle part 10. The back 6 delimits the bottom of the watch case 2. The crystal 8 closes the top of the watch case 2 and is transparent to define a useful display opening 12. The middle part 10 connects the back 6 and the crystal 8 to one another. Horns 14 are provided on either side of the middle part 10 and enable in a manner known per se the fastening of a bracelet 16 to attach the timepiece 1 to a user's wrist. The invention may obviously be applied to other types of timepieces, such as pocket watches.

The timepiece 1 also comprises an hour hand 18 and a minute hand 20 intended to display civil time. The hour hand 18 and minute hand 20 are housed in the internal volume 4 of the watch case 2, between the crystal 8 and the back 6. The hour hand 18 and minute hand 20 are herein opaque and perceptible via the useful display aperture 12. The hour hand 18 and minute hand 20 are rotatably mounted with respect to the watch case 2, about the same axis substantially perpendicular to the crystal 8.

The timepiece 1 also comprises a horological movement 22. This horological movement 22 is housed in the internal volume 4 of the watch case 2. The horological movement 22 is herein concealed by an opaque upper edge 24 of the middle part 10. Although in the example illustrated in the drawing, the horological movement 22 is concealed from the owner's view, it is also possible to envisage rendering same visible via the useful display aperture 12, so as to increase the mystery effect obtained by the lack of visible mechanical driving linkage between this horological movement 22 and the hour hand 18 and minute hand 20.

The timepiece 1 comprises herein a power supply source 26 and an electronic power supply and control circuit 28 connected to the power supply source 26. The power supply source 26 and the electronic power supply and control circuit 28 are also concealed by the middle part 10. The electronic power supply and control circuit 28 is arranged to power an electric motor (not shown) arranged to drive the horological movement 22 by means of the power supplied by the power supply source 26. The timepiece 1 illustrated herein is therefore of the electromechanical type. The invention is obviously applicable in the same way to mechanical type timepieces.

The hour hand 18 and minute hand 20 are rotated by the horological movement 22 via respective driving belts, namely an hour belt 30 and a minute belt 32. The hour driving belt 30 and minute driving belt 32 are for example notched belts. The hour driving belt 30 and minute driving belt 32 are for example made of silicone. Though intended to be imperceptible to the owner, the hour driving belt 30 and minute driving belt 32 are obviously illustrated as visible in FIGS. 1 and 2 for a clearer understanding of the invention. In order to be able to drive the hour hand 18 and minute hand 20, the hour driving belt 30 and minute driving belt 32 extend at least partially in the useful display aperture 12.

According to the invention, the internal volume 4 of the watch case 2 is filled with a fluid 34 in which the hour driving belt 30 and minute driving belt 32 are submerged. The fluid 34 fills the internal volume 4 of the watch case 2 so as to prevent the presence of visible gas pockets or bubbles. According to the preferred but non-exclusive embodiment of the invention, the fluid 34 is typically a liquid or a transparent oil bath. Due to the transparency thereof, the fluid 34 enables the user to see the internal volume 4 of the watch case 2, particularly under the hour hand 18 and minute hand 20. The use of a transparent fluid 34 also makes it possible to limit parasitic glare on the different components present in the internal volume 4 of the watch case 2.

In order to prevent the user from being able to distinguish the hour driving belt 30 and minute driving belt 32 via the useful display aperture 12, the optical refractive indexes of the fluid 34 and of the hour driving belt 30 and minute driving belt 32 are substantially equal. The ratio between the ,optical refractive index of the fluid 34 and that of the hour driving belt 30 and minute driving belt 32 is for example advantageously between 0.9 and 1,1, and preferably between 0.95 and 1.05. Thus, at the interface between the fluid 34 and the hour driving belt 30 and minute driving belt 32, the light is practically entirely transmitted, which prevents the user from perceiving out the hour driving belt 30 and minute driving belt 32.

Advantageously, the back 6 is also transparent, which enables the user observing the useful display aperture 12 to see through the timepiece 1 to the back crystal 6. The timepiece 1 can thus give the user the impression that the hour hand 18 and minute hand 20 are floating in the internal volume 4 of the watch case 2 and are not rotated by any mechanism.

An example of a hand driving and guiding structure is illustrated more specifically in FIG. 2. The timepiece 1 includes an hour pipe 36, rotatably mounted with respect to the watch case 2 and whereon the hour hand 18 is attached. The timepiece 1 further includes a minute pipe 38, rotatably mounted with respect to the watch case 2 and whereon the minute hand 20 is attached.

The minute pipe 38 includes a first end 38*a* housed in a recess 40*a* of the crystal 8, and a second end 38*b* housed in a recess 40*b* of the back 6. The minute pipe 38 is thus rotatably mounted about an axis perpendicular to the crystal 8 and perpendicular to the back 6. The minute pipe 38 may further be guided in rotation by a bridge 42 or by a transparent plate traversed thereby. The bridge 42 may be transparent. The hour pipe 36 is rotatably mounted about the minute pipe 38, positioned coaxially about this minute pipe 38. The axial position of the hour pipe 36 is defined by the bridge 42 at the lower end thereof, and by a washer 46 at the upper end thereof. The hour pipe 36 may include a shoulder to abut against the bridge 42. The washer 46 may be force-fitted about the minute pipe 38. The washer 46 may be transparent.

The minute pipe 38 has a fluted lower end, positioned under the bridge 42. This fluted end forms a minute toothing 48. This minute toothing 48 may also be provided by a fluted pinion driven on the minute pipe 38. The fluted minute driving belt 32 engages with the minute toothing 48 of the minute pipe 38. The minute driving belt 32 can thus rotate the minute pipe 38 without sliding. The hour pipe 36 also has a fluted lower end situated over the bridge 42. The fluted end of the hour pipe 36 forms an hour toothing 50. This hour toothing 50 may also be provided by a fluted pinion driven on the hour pipe 36. The notched hour driving belt 30 engages with the hour toothing 50. The hour driving belt 30 can thus rotate the hour pipe 36 without sliding. The hour pipe 36 and minute pipe 38 may be made of a transparent material, having an optical refractive index substantially equal to that of the fluid 34.

Figure 3:
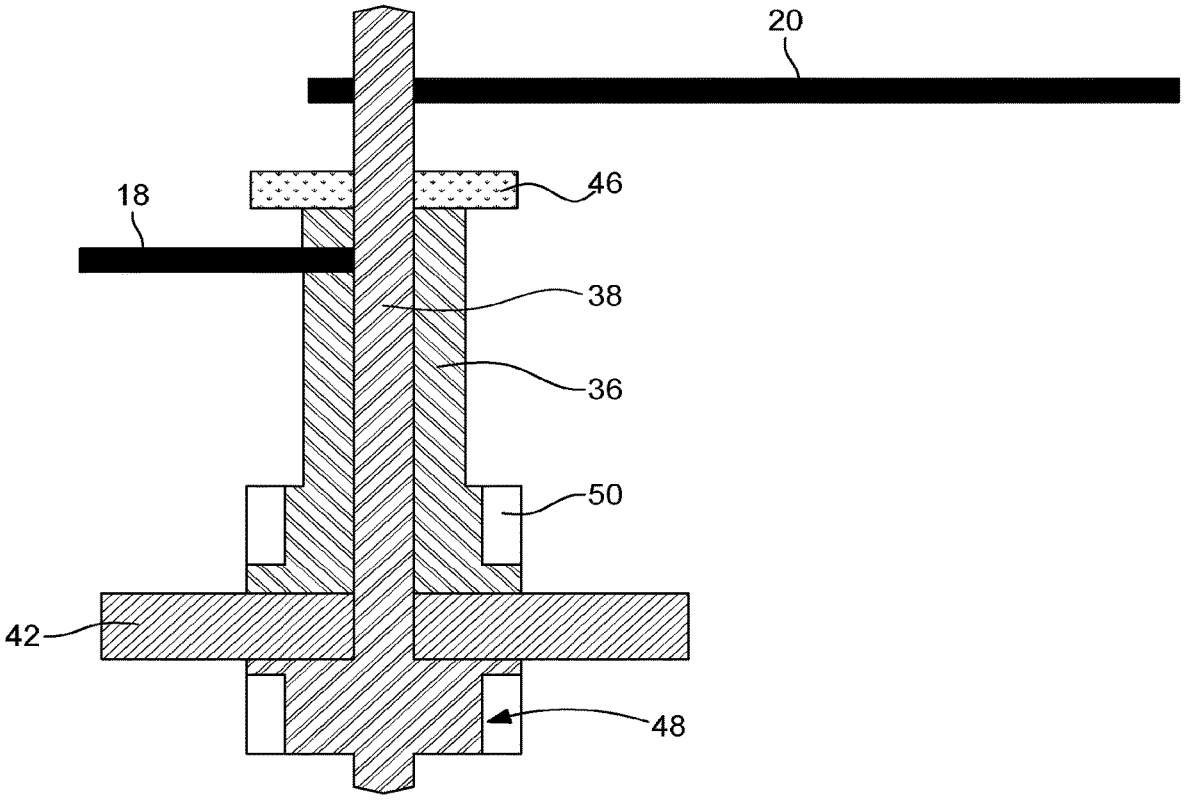
FIG. 3 is a sectional view of the hand support arbors.

FIG. 3 illustrates an example of fastening of the hour hand 18 and minute hand 20 on the hour pipe 36 and minute pipe 38 respectively. The hour hand 18 and minute hand 20 are herein forcibly driven into respective radial holes of the hour pipe 36 and minute pipe 38.

It is obvious that the present invention is not limited to the embodiment described above and that various simple modifications and variants may be envisaged by those skilled in the art without departing from the scope of the invention as defined in the appended claims. It will be noted in particular that the fluid with which the internal volume of watch case is filled as well as the driving belts may also be translucent, i.e. be transparent while diffusing light. The fluid and the driving belts may also have a colour, i.e. filter a part of the visible spectrum in order to highlight a coloured appearance. Such colouring may for example make it possible to highlight a colour of the hour and minute hands further. The fluid may also include suspended opaque particles.

Figure 4:
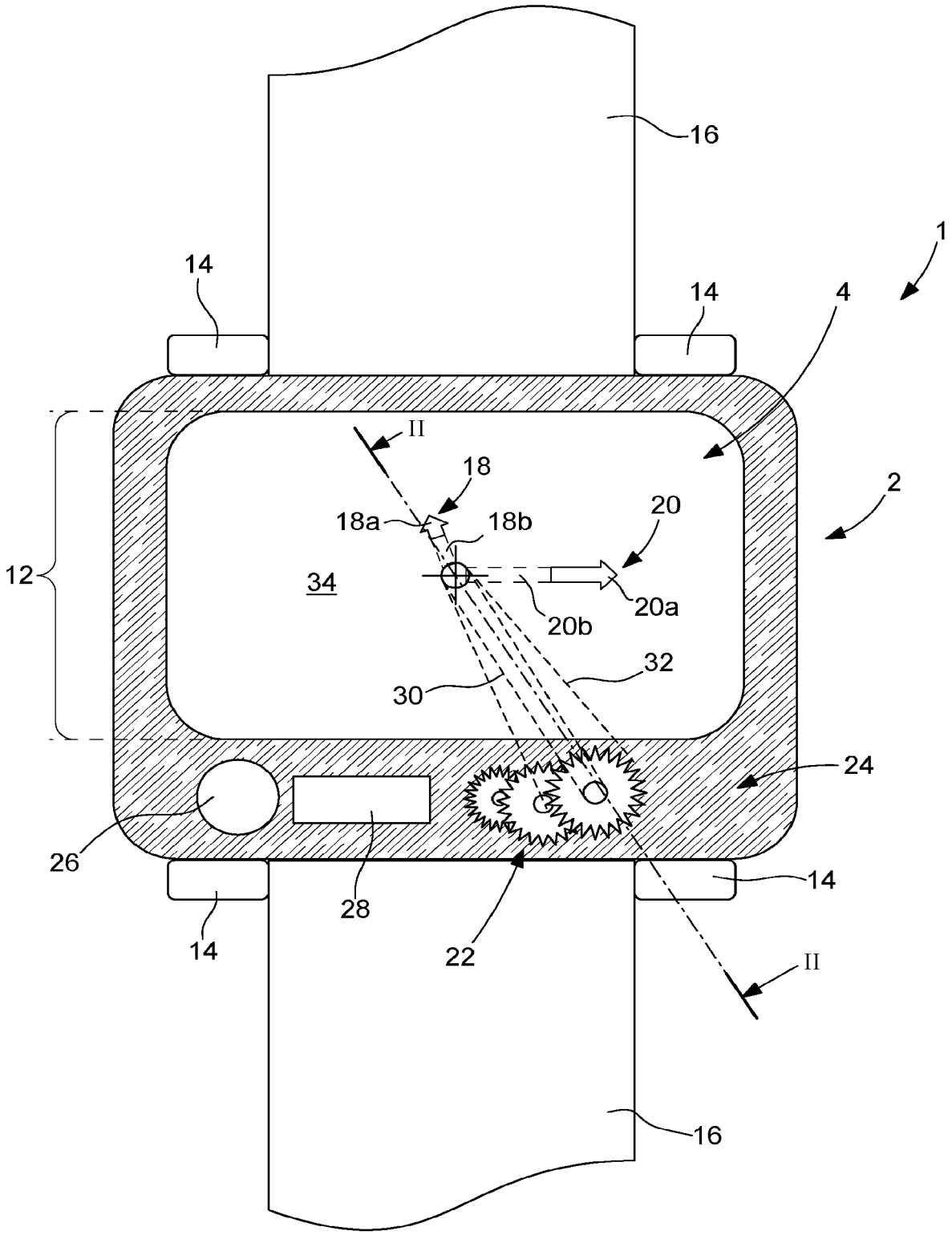
FIG. 4 is a similar view to that of FIG. 1 illustrating a further embodiment of the invention.

According to a particular embodiment of the invention illustrated in FIG. 4, only the end 18*a*, 20*a* of the hour hand 18, respectively of the minute hand 20, is visible, whereas the portion 18*b*, 20*b* connecting the end 18*a*, 20*a* of the hour hand 18, respectively of the minute hand 20, to the hour pipe 36, respectively to the minute pipe 38, is made of a material whose optical refractive index is the same or very similar to the optical refractive index of the fluid 34. This particular embodiment of the invention makes it possible to reinforce the mystery effect of the timepiece according to the invention further by providing a mechanism wherein only the ends of the hour and minute hands are perceptible and move with respect to the watch case, without any apparent linkage with the centre of the watch case.

According to a further particular embodiment of the invention, the material used to produce the hour driving belt 30 and the minute driving belt 32 is charged with a small percentage, typically between 1% and 10%, of fluorescent or phosphorescent pigments which, only under particular lighting or in the dark, makes it possible to reveal the mechanical linkage invisible under normal conditions between the hour hand and the minute hand and the hour and minute pipes bearing same.

REFERENCE LIST

1. Timepiece of the wristwatch type
2. Watch case
4. Internal volume
6. Back
8. Crystal
10. Middle part
12. Useful display aperture
14. Horns
16. Bracelet
18. Hour hand
18*a*. End of the hour hand
18*b*. Portion connecting the end of the hour hand to the hour pipe
20. Minute hand
20*a*. End of the minute hand
20*b*. Portion connecting the end of the minute hand to the minute pipe
22. Horological movement
24. Upper edge
26. Power supply source
28. Electronic power supply and control circuit
30. Hour driving belt
32. Minute driving belt
34. Fluid
36. Hour pipe
38. Minute pipe
38*a*. First end
38*b*. Second end
40*a*. Recess
40*b*. Recess
42. Bridge
46. Washer
48. Minute toothing
50. Hour toothing

The invention claimed is:

1. A mechanical or electromechanical timepiece comprising a watch case delimiting an internal volume, said watch case comprising:

a back delimiting the watch case at a bottom;

a crystal closing the watch case at a top, said crystal defining a useful display aperture;

a middle part connecting the back and the crystal to one another;

a horological movement housed in the internal volume of the watch case;

a first hand for displaying information fastened onto a first pipe, said first hand being visible via the useful display aperture and being rotated with respect to the watch case by the horological movement with a first driving belt extending at least partially in the useful display aperture; and a second hand for displaying information fastened to a second pipe is arranged in the useful display aperture and is rotated with respect to the watch case by the horological movement with a second driving belt extending at least partially in the useful display aperture, wherein the timepiece comprises the internal volume of the watch case filled with a fluid wherein the first and second driving belts are submerged, and wherein the first and second driving belts are made of a material whose optical refractive index is equal or substantially equal to that of the fluid, wherein a first end portion connecting each of the first hand and the second hand to the first pipe and second pipe respectively, is made of a material wherein the optical refractive index of the portion is the same as or similar to the optical refractive index of the fluid such that only a second end portion of each of the first hand and second hand is visible.

2. The timepiece according to claim 1, wherein the ratio between the optical refractive index of the fluid and that of the material of the first and second driving belts is between 0.9 and 1.1.

3. The timepiece according to claim 1, wherein the fluid is transparent.

4. The timepiece according to claim 1, wherein the fluid and the first and second driving belts have a colour and filter a part of the visible spectrum so as to highlight a coloured appearance.

5. The timepiece according to claim 4, wherein the fluid includes suspended opaque particles.

6. The timepiece according to claim 1, wherein the fluid is a liquid or an oil bath.

7. The timepiece according to claim 1, wherein the material used to produce the first and second driving belts is charged with a fluorescent or phosphorescent pigment.

8. The timepiece according to claim 7, wherein the material with which the first and second driving belts are made is charged with a percentage of fluorescent or phosphorescent pigment between 1% and 10%.

9. The timepiece according to claim 1, wherein the first and second driving belts made of silicone.

10. The timepiece according to claim 1, wherein first and second driving belts are notched and engage with a toothing for each of the first pipe and the second pipe respectively whereon the first hand and second hand are respectively fixedly mounted.

11. The timepiece according to claim 10, wherein the toothing is transparent and has an optical refractive index substantially equal to that of the at first and second notched driving belt.

12. The timepiece according to claim 1, wherein the horological movement is arranged outside the useful display aperture.

13. The timepiece according to claim 1, wherein the back is transparent.

14. The timepiece according to claim 1, wherein the internal volume of the watch case is devoid of gas pockets.

15. A mechanical or electromechanical timepiece comprising a watch case delimiting an internal volume, said watch case comprising:

a back delimiting the watch case at a bottom;

a crystal closing the watch case at a top, said crystal defining a useful display aperture;

a middle part connecting the back and the crystal to one another;

a horological movement housed in the internal volume of the watch case;

a first hand for displaying information fastened onto a first pipe, said first hand being visible via the useful display aperture and being rotated with respect to the watch case by the horological movement with a first driving belt extending at least partially in the useful display aperture; and a second hand for displaying information fastened to a second pipe is arranged in the useful display aperture and is rotated with respect to the watch case by the horological movement with a second driving belt extending at least partially in the useful display aperture, wherein the timepiece comprises the internal volume of the watch case filled with a fluid wherein the first and second driving belts are submerged, and wherein the first and second driving belts are made of a material whose optical refractive index is equal or substantially equal to that of the fluid, wherein the second hand is fastened to a second pipe and is arranged in the useful display aperture, and wherein the first pipe and the second pipe have an optical refractive index equal or substantially equal to that of the fluid.

* * * * *